US005610471A

United States Patent [19]

Bandy et al.

[11] Patent Number: 5,610,471

[45] Date of Patent: Mar. 11, 1997

[54] SINGLE FIELD EMISSION DEVICE

[75] Inventors: Steve G. Bandy, Sunnyvale; Clifford K. Nishimoto, San Jose; Christopher Webb, Los Alto; Ross A. LaRue, Milpitas, all of Calif.

[73] Assignee: Varian Associates, Inc., Palo Alto, Calif.

[21] Appl. No.: 409,479

[22] Filed: Mar. 22, 1995

Related U.S. Application Data

[63] Continuation of Ser. No. 910,957, Jul. 7, 1993, abandoned.

[51] Int. Cl.[6] ..... H01J 1/46; H01J 1/62

[52] U.S. Cl. ..... 313/309; 313/495; 313/496; 313/497

[58] Field of Search ..... 313/309, 336, 313/351, 495, 496, 497, 498, 499

[56] References Cited

U.S. PATENT DOCUMENTS

| | | | |
|---|---|---|---|
| 3,947,716 | 3/1976 | Fraser, Jr. et al. | 313/336 |
| 5,214,347 | 5/1993 | Gray | 313/355 |
| 5,217,401 | 6/1993 | Watanabe | 313/351 |
| 5,245,247 | 9/1993 | Hosogi | 313/336 X |
| 5,300,853 | 4/1994 | Watanabe | 313/351 |
| 5,319,233 | 6/1994 | Kane | 313/308 |
| 5,329,207 | 7/1994 | Cathey | 313/309 |
| 5,343,110 | 8/1994 | Kaneko | 313/351 |
| 5,382,867 | 1/1995 | Maruo | 313/309 |

FOREIGN PATENT DOCUMENTS

| | | |
|---|---|---|
| 044670 | 4/1991 | European Pat. Off. . |
| WO92/04732 | 3/1993 | WIPO . |

OTHER PUBLICATIONS

Spitzer, Stuart M. et al. "A Brief Review of the State of the Art and Some Recent Results on Electromigration in Integrated Circuit Aluminum Metallization," *Electrochemical Science*, Oct. 1969, V. 116, No. 10, pp. 1368–1372.

Wolfe, J.E. "Operational Experience with Zirconiated T–F Emitters," *J. Vac. Sci. Technol.*, 16(6), Nov./Dec. 1979, pp. 1704–1708.

Jones, Gary W. "Self Aligned Vertical Field Emitter Devices Fabricated Utilizing Liftoff Processing," *3d Int'l Vacuum Microelectronics Conf.* Jul. 23–25, 1990, p. 1–2.

Warner, K. et al. "Oxidation Sharpened Gated Field Emitter Array Process," *3d Int'l Vacuum Microelectronics Conf.*, Jul. 23–25, 1990, p. 25.

Branston, David W. et al. "Field Emission from Metal Coated Silicon Tips," *3d Int'l Vacuum Microelectronics Conf.*, Jul. 23–25, p. 5–4.

Marcus, R.B. "Formation of Sharp Silicon and Tungsten Tips," *3d Int'l Vacuum Microelectronics Conf.*, Jul. 23–25, 1990, pp. 1–3.

Bandy, S. et al. "Thin Film Emitter Development," *Technical Digest of IVMC 91*, Aug. 1991, pp. 118–119.

*Primary Examiner*—Louis M. Arana
*Assistant Examiner*—John Ning
*Attorney, Agent, or Firm*—Bella Fishman; David Power

[57] ABSTRACT

A field emission device (100) uses single crystals in order to eliminate grain boundaries within some or all of the electrodes (103, 104, and 205). The elimination of grain boundaries reduces susceptibility to damage, improves stability of the device (100), and improves uniformity and reproducibility among devices. In a preferred embodiment, the emitter and gate electrodes (103 and 104 respectively) are formed from a single crystal thin film (302). In other embodiments, other structures are employed wherein one or more of the electrodes (103, 104, and 205) are formed from single crystals.

6 Claims, 4 Drawing Sheets

SINGLE FIELD EMISSION DEVICE

This is a continuation of application Ser. No. 910,957 filed Jul. 7, 1993, now abandoned.

TECHNICAL FIELD

This invention pertains to the field of field emission devices, and particularly relates to a device in which some or all of the electrodes are formed from single crystal material.

BACKGROUND ART

Field emission devices are microscopic electrical components which selectively emit electrons. Such devices 100, as shown in FIGS. 1*a* and 1*b*, generally comprise two electrodes: an emitter electrode 103 for emitting electrons and a gate electrode 104 for controlling the flow of electrons from the emitter electrode 103 depending on the electrical charge present at the gate 104. The electrodes are typically mounted on some kind of substrate 101 or 105 to provide support for the device, with a gap between the electrodes. A third electrode, the anode (not shown in FIGS. 1*a* and 1*b*), may also be present to receive the emitted electrons, although in some devices the gate electrode 104 serves as the anode.

Field emission devices have been known for several years to have many potential applications in commercial and military industry, such as: high-definition television; flat-panel video displays; radiation-hard thermally insensitive integrated circuits; microsensors; fast electron sources for vacuum tubes; and electron microscopes. However, there are a number of practical difficulties associated with such devices which have inhibited their widespread use. Three such problems are 1) their extreme sensitivity to damage, 2) their instability evidenced by a tendency towards microstructure changes with use, and 3) the difficulty of manufacturing such devices with sufficient uniformity and reproducibility. The following references detail these problems, and describe the state of the prior art in the manufacture of emission devices.

U.S. Pat. No. 3,947,716 discloses a field emission tip and process wherein a metal adsorbate is selectively deposited on the tip to create a selectively faceted tip with the emitting planar surface having a reduced work function and the non-emitting planar surfaces having an increased work function, thus yielding improved performance. The patent discloses the use of a single crystal to fabricate emission tips, but the reason for single crystal use in emission tips has traditionally been to facilitate fabrication of a cone-shaped emitter. The patent does not mention the use of single crystals for the other electrodes of the device, nor does it suggest the use of single crystals in conjunction with thin film emitters or for stability and arc damage resistance.

S.M. Spitzer and S. Schwartz, "A Brief Review of the State of the Art and Some Recent Results on Electromigration in Integrated Circuit Aluminum Metallization", *I. Electrochem. Soc.* v. 116, p. 1368 (1969), discusses some of the problems associated with electromigration in integrated circuit devices. Electromigration phenomena have been found to cause instability and susceptibility to damage in emission devices. The article does not mention the use of single crystal material to reduce electromigration problems.

J. E. Wolfe, "Operational Experience with Zirconiated T-F Emitters", *I. Vac., Sci. Technology.* v. 16, p. 1704 (1979), discusses the characteristics of an electron gun which uses a cathode-filament structure with a needle-shaped cathode. It discusses some techniques for improving performance and extending device lifetime, but does not mention grain boundaries or single-crystal structures.

G. W. Jones, C. T. Sune, and H. F. Gray, "Self-Aligned Vertical Field Emitter Devices Fabricated Utilizing Liftoff Processing", *3d Int'l Vacuum Microelectronics Conf.*, Jul. 23–25, 1990, Monterey, Calif., poster 1–2, sets forth a method of fabricating vertically self aligned field emitter cathodes and extraction electrodes utilizing liftoff process and anisotropic silicon etching. This technique involves first forming silicon dioxide islands on heavily doped N+ silicon and then using those islands as etch masks to form flat topped pyraraids with silicon dioxide overhanging caps.

R. B. Marcus et al., "Formation of Sharp Silicon and Tungsten Tips", *3d Int'l Vacuum Microelectronics Conf.*, Jul. 23–25, 1990, Monterey, Calif., paper 1–3, describes a variation on a previously known procedure for forming atomically-sharp silicon tips of between 10° and 15° half-angle by utilizing oxidation inhibition at regions of high curvature for silicon tips. The variation employs a chemical vapor process to form similar tips out of tungsten.

K. Warner, N. M McGruer, and C. Chan, "Oxidation Sharpened Gated Field Emitter Array Process", *3d Int'l Vacuum Microelectronics Conf.*, Jul. 23–25, 1990, Monterey, Calif., poster P-25, discusses a process for fabricating gated field-emission cathodes with sharp tips by oxidation.

D. W. Branston and D. Stephani, "Field Emission from Metal Coated Silicon Tips", *3d Int'l Vacuum Microelectronics Conf.*, Jul. 23–25, 1990, Monterey, Calif., paper 5–4, describes emission properties of various groupings of emitters formed as arrays of silicon tips coated with various refractory metals by physical vapor deposition techniques.

The methods set forth in the above-referenced articles generally represent the state of the art in manufacturing techniques for emission devices.

S. Bandy, C. Nishimoto, R. LaRue, W. Anderson, and G. Zdasiuk, "Thin Film Emitter Development", *Technical Digest of IVMC* 91 (August, 1991), p. 118, published within one year of the instant patent application, describes an emission device manufacturing method using thin films. It sets forth the properties and advantages of thin film emitters in comparison with traditional cone-shaped emitters. These two structures for emission devices are shown in FIGS. 1*a* and 1*b* of the instant patent application. FIG. 1*a* shows a well-known cone emitter structure, in which a cone-shaped emitter electrode 103 is mounted on a conducting substrate 101 (as stated in "Thin Film Emitter Development", "virtually all structures reported in the literature use conducting substrates."). Devices of this type are commonly manufactured using etching or metal closure techniques. FIG.1*b* shows the newer "edge emitter" structure discussed in "Thin Film Emitter Development", in which an edge of the emitter 103 protrudes from between an insulator 102 and a metal overlay 106. This structure usually employs an insulating substrate 105. Edge emitters offer several potential advantages over cone-shaped emitters, including improved reproducibility and uniformity, high current densities, and high frequency performance. Even with these advantages, however, the three problems mentioned above persist.

Although it has been known in the art for some time that the use of single crystals facilitates fabrication of cone-shaped emitter electrodes, the benefits of single crystals in improving stability and uniformity and reducing damage have not been previously known. Accordingly, they have not been used for the other electrodes of the device (namely the gate and the anode), nor have they been used for non-cone-shaped emitters. None of the prior art suggests the novel features of the present invention, in which single crystals are used to form some or all of the electrodes of the device, not just cone-shaped emitters, in order to alleviate the problems of uniformity, reproducibility, stability, and sensitivity to damage.

DISCLOSURE OF INVENTION

The present invention describes a field emission device (100) and manufacturing method which minimize the problems of sensitivity to damage, instability, and lack of uniformity, by forming some or all of the electrodes of the device out of single crystals having no grain boundaries.

Research conducted in connection with development of the present invention has shown that grain boundaries within the electrodes (103, 104, and 205) of field emission devices (100) contribute to all three problems described above. One effective way of eliminating grain boundaries within an electrode (103, 104 or 205) is to fabricate the electrode (103, 104 or 205) from a single crystal. Consequently, the present invention describes a field emission device (100) that uses single crystal electrodes in order to avoid the presence of grain boundaries within electrodes (103, 104 or 205), thus minimizing arc damage and improving stability, reproducibility, and uniformity. Single crystals may be used on any or all of the electrodes (103, 104 or 205) of the device (100).

In a preferred embodiment, the emitter and gate electrodes (103 and 104 respectively) are formed from the same single crystal thin film, by a method which etches a gap (203) in the crystal to define the two electrodes (103 and 104). Alternatively, the emitter and gate electrodes (103 and 104 respectively) can be formed from two independent single crystal thin films, or the electrodes (103 and 104) can be configured using any other emission device structure, including, for example, traditional cone emitter structures. In any of these alternatives, the gate electrode (104), the emitter electrode (103), or both may be single crystal. Optionally, a single crystal anode electrode (205) may also be used to further reduce the aforementioned problems.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 2:
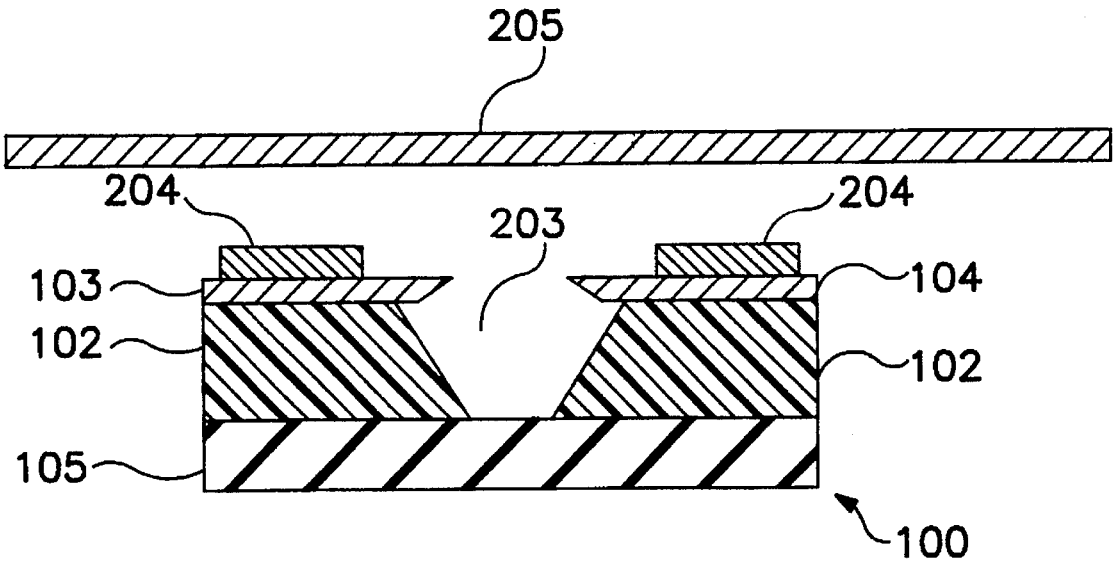
FIG. 2 is a sectional diagram of a single crystal thin film emission device 100 in accordance with a preferred embodiment of the present invention.

Referring now to FIG. 2, there is shown a sectional diagram of a preferred embodiment of a field emission device 100 according to the present in- vention. Two insulators 102 made from, e.g., aluminum gallium arsenide are deposited on an insulating substrate 105 made from, e.g., gallium arsenide. The insulators 102 are shown spaced apart, but they need not be. The emitter and gate electrodes, 103 and 104 respectively, are formed from a single thin film of e.g., heavily doped gallium arsenide and rest on the insulators 102, so that a gap 203 is formed between the two electrodes. Ohmic contacts 204 are fastened to the emitter and gate electrodes to facilitate electrical contact with the device. An anode electrode 205, separated from the other components of the device and also formed from a single crystal, may also be present to collect the emitted electrons, or, alternatively, the gate electrode 104 may function as an anode.

Referring now to FIGS. 3*a*–3*f*, there is shown a preferred method for manufacturing field emission devices 100 according to the present invention. One skilled in the art will readily recognize that alternative embodiments of this method may be employed without departing from the principles of the invention described herein.

Figure 3A:
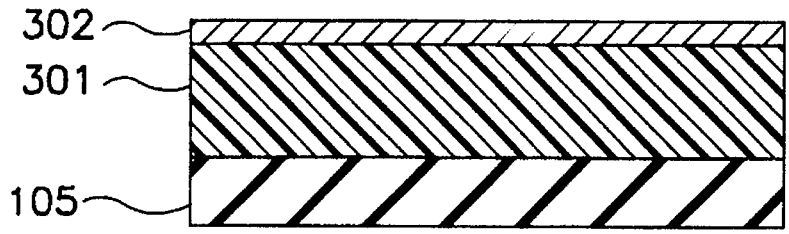
FIGS. 3*a* through 3*f* illustrate a preferred method of manufacturing the single crystal thin film emission device 100 according to the present invention. These Figures are sectional diagrams of the device 100 at six stages of the preferred manufacturing process.

In FIG. 3*a*, the starting material for the process is shown. There is provided an insulating substrate 105 of gallium arsenide. Deposited on the substrate is a buffer layer 301 of aluminum gallium arsenide, approximately 5 microns thick. Finally, on the buffer layer 301 is a single crystal thin film (approximately 1000 angstroms thick) of conducting material 302, preferably heavily doped gallium arsenide. Other materials and thicknesses may be used.

Figure 3B:
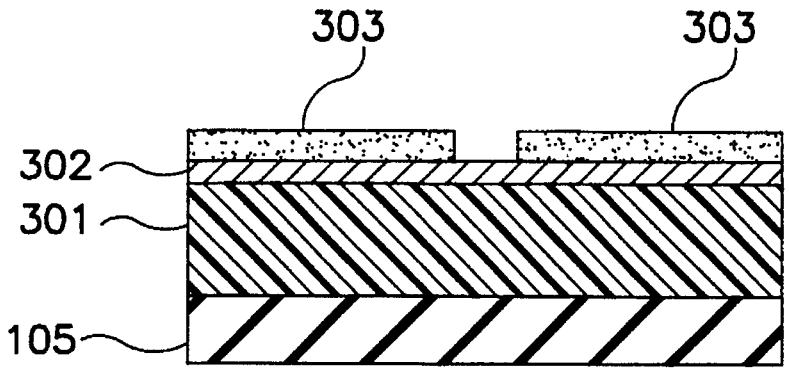

In FIG. 3*b*, a layer of photoresist 303 is applied on top of the conducting layer 302, according to well-known device manufacturing techniques. The photoresist is applied in a pattern which will eventually define the placement of the electrodes 103 and 104 on the final device, by leaving gaps where the conducting material 302 is to be removed.

Figure 3C:
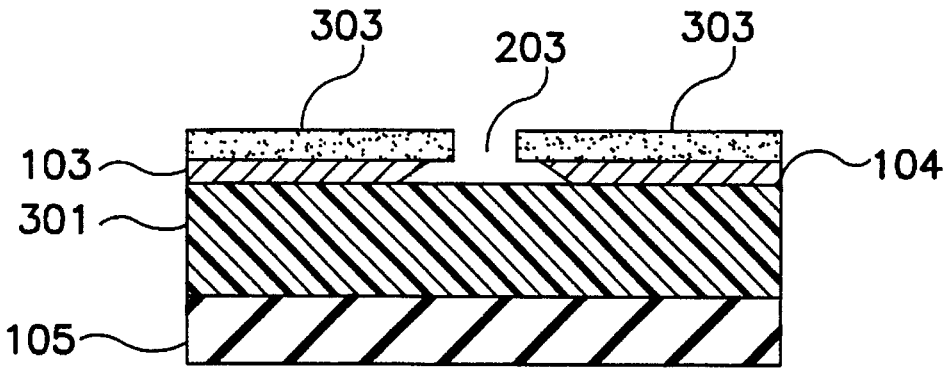

In FIG. 3c, the conducting layer 302 is etched according to well-known device manufacturing techniques. Wherever photoresist 303 is present, the conducting layer 302 remains intact, but where there is a gap in the photoresist 303, the conducting layer 302 is etched away. In this way, two electrodes 103 and 104 are formed, with a gap 203 between them. Electrode 103 will eventually become the emitter and electrode 104 will become the gate.

Figure 3D:
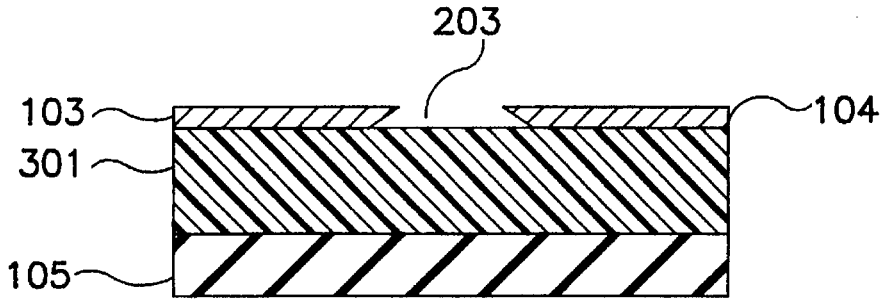

In FIG. 3*d*, the photoresist 303 is removed.

Figure 3E:
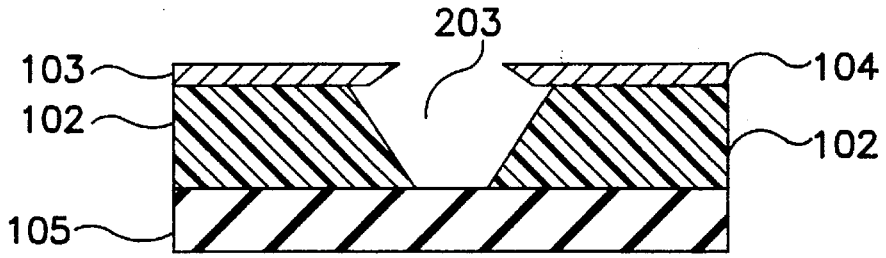

In FIG. 3*e*, the buffer layer 301 is etched out under the gap 203, so that there is some overhang of the electrodes 103 and 104. The buffer layer 301 thus becomes two aluminum gallium arsenide insulators 102. In an alternative embodiment, the buffer layer may not be etched out, or may only be partially etched out, so that insulators 102 are touching.

Figure 3F:
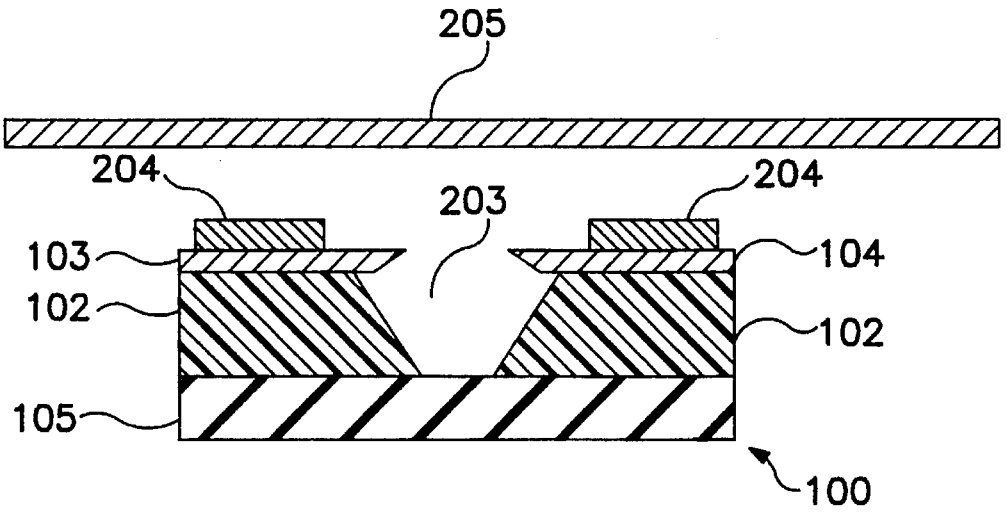

In FIG. 3*f*, ohmic contacts 204 are attached to the electrodes 103 and 104 so that electrical connections can be made to the device 100. An anode electrode 205 is also shown, although this is optional; if no anode 205 is present, the gate electrode 104 acts as an anode. The anode 205, if present, may be made of heavily doped gallium arsenide, or gold, or any other conducting material. It may be formed from a single crystal, although this is not necessary. It may or may not be formed from a thin film, and may even be formed from the same film as the other two electrodes (for example, in a coplanar arrangement).

Figure 1A:
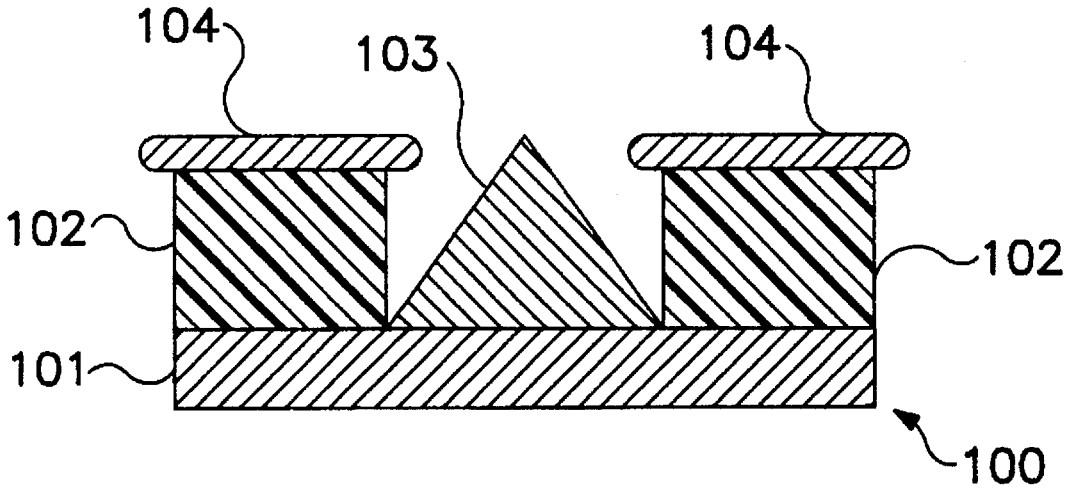
FIG. 1a (PRIOR ART)
FIG. 1*a* is a sectional diagram of a field emission device 100 having a cone-shaped emitter 103 according to the prior art.
Figure 1B:
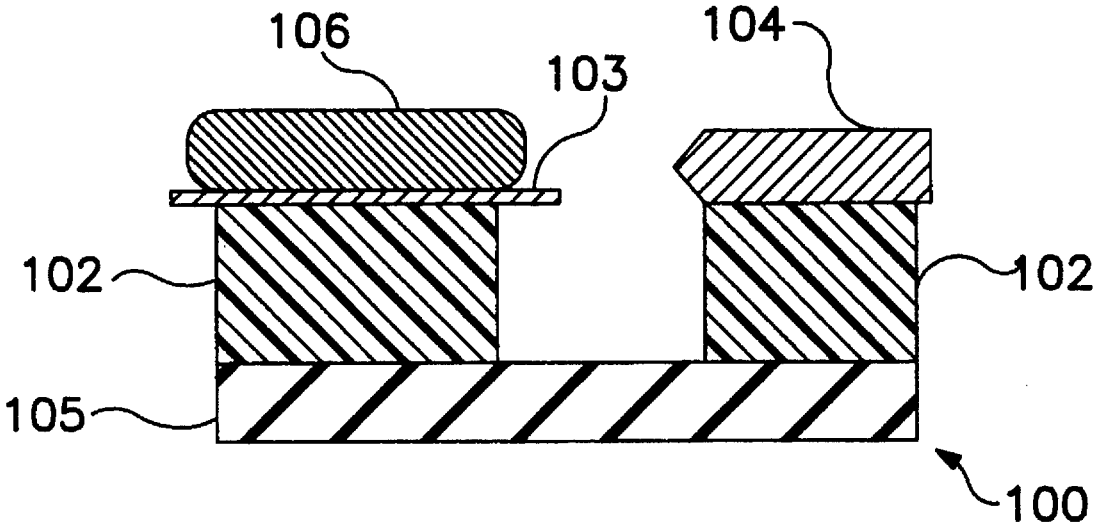
FIG. 1*b* is a sectional diagram of a thin film field emission device 100 having an edge emitter structure 103.

From the above description, it will be apparent that the invention disclosed herein provides a novel and advantageous field emission device 100 and method for producing same. The foregoing discussion discloses and describes merely exemplary methods and embodiments of the present invention. As will be understood by those familiar with the art, the invention may be embodied in many other specific forms without departing from the spirit or essential characteristics thereof. For example, other materials may be used in place of those mentioned. In addition, the emitter and gate electrodes, 103 and 104 respectively, may be formed from two separate single crystal thin films, rather than from one piece 302. Also, the invention may be practiced with other device structures wherein differently shaped electrodes, such as the traditional cone-emitter structure of FIG. 1*a*, are employed in place of thin film electrodes. Finally, the invention may be practiced using single crystals for some but not all of the electrodes.

Accordingly, the disclosure of the present invention is intended to be illustrative of the preferred embodiments and is not meant to limit the scope of the invention. The scope of the invention is to be limited only by the following claims.

What is claimed is:

1. A field of emission device having improved damage resistance comprising:

a single crystal, thin film gate electrode having no grain boundaries therein; and a single crystal, thin film emitter electrode having no grain boundaries therein, and an upwardly angled edge emitter for generating an arcurate electron flow path, wherein said electrons bypass the high field area created between said gate and emitter electrodes, thereby substantially eliminating the production of secondary ions within said high field area and reducing the arcing potential therein.

2. The device of claim 1 wherein the emitter electrode is in a position diametrically opposed to said gate electrode.

3. The device of claim 2 wherein the thin film is formed from gallium arsenide.

4. The device of claim 2 further comprising a single crystal, thin film anode spaced apart from the emitter electrode and positioned to receive the arcurate electron flow from said emitter electrode.

5. The device of claim 2 wherein the gate and emitter electrodes are formed from a same single crystal.

6. A field emission device having improved damage resistance comprising:

an insulating substrate:

a first insulator mounted on said substrate;

a second insulator mounted on said substrate adjacent to the first insulator;

an edge emitter electrode formed from a first thin film of a single crystal gallium arsenide, said edge emitter having an upwardly angled edge portion to generate an arcurate electron flow pattern, said edge emitter mounted on said first insulator;

a metal overlay mounted on said edge emitter so as to cause said edge portion to extend beyond the metal overlay; and a gate electrode formed from said first thin film of single crystal gallium arsenide, said gate mounted on the second insulator in a position diametrically opposed to said edge emitter, said gate initiating electron flow from said edge emitter, wherein said arcurate path of said electrons bypass the high field area created between said gate and said emitter and substantially eliminate the production of secondary ions, thereby reducing the arcing potential for said device.

* * * * *